US011404185B2

(12) United States Patent
Yamaguchi et al.

(10) Patent No.: US 11,404,185 B2
(45) Date of Patent: Aug. 2, 2022

(54) WATER-STOP GROMMET AND WIRE HARNESS

(71) Applicants: Yazaki Corporation, Tokyo (JP); TOYOTA JIDOSHA KABUSHIKI KAISHA, Aichi-ken (JP)

(72) Inventors: Masaki Yamaguchi, Aichi (JP); Ryohei Toyoda, Aichi (JP); Tomoyoshi Katayama, Aichi (JP)

(73) Assignees: YAZAKI CORPORATION, Tokyo (JP); TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/164,471

(22) Filed: Feb. 1, 2021

(65) Prior Publication Data

US 2021/0241944 A1 Aug. 5, 2021

(30) Foreign Application Priority Data

Feb. 3, 2020 (JP) ..... JP2020-016056

(51) Int. Cl.
*H01B 17/58* (2006.01)
*H01B 7/00* (2006.01)

(52) U.S. Cl.
CPC ..... *H01B 17/583* (2013.01); *H01B 7/0045* (2013.01)

(58) Field of Classification Search
None
See application file for complete search history.

(56) References Cited

U.S. PATENT DOCUMENTS 5,545,854 A * 8/1996 Ishida ..... H02G 3/081 16/2.2
6,708,366 B2 * 3/2004 Ono ..... H02G 3/22 16/2.5
6,822,165 B2 * 11/2004 Nishimoto ..... B60R 16/0222 174/152 G
7,105,750 B1 * 9/2006 Duhr ..... B60R 16/0222 174/650

(Continued)

FOREIGN PATENT DOCUMENTS

CN 1397456 A * 2/2003 ..... B60R 16/0222
CN 102084563 A 6/2011

(Continued)

*Primary Examiner* — Timothy J. Dole
*Assistant Examiner* — Muhammed Azam
(74) *Attorney, Agent, or Firm* — Kenealy Vaidya LLP

(57) ABSTRACT

A grommet includes a water stop part having an annular shape that stops water by being inserted into a through hole formed on a mounting panel, and a first partition wall part or a second partition wall part disposed so as to close the annular shape of the water stop part by extending in a radially inner side of the water stop part. The water stop part includes an abutting surface formed in an annular shape capable of coming into contact with one side of a peripheral part of the through hole in an axial direction, and a plurality of claw parts that face the abutting surface in the axial direction, that are capable of coming into contact with another side of the peripheral part of the through hole, and that are intermittently provided in a circumferential direction.

9 Claims, 4 Drawing Sheets

(56) References Cited

U.S. PATENT DOCUMENTS

| | | | | |
|---|---|---|---|---|
| 8,461,457 | B2 * | 6/2013 | Miyakoshi | H02G 3/22 174/152 G |
| 9,083,168 | B2 * | 7/2015 | Kamenoue | B60R 16/0222 |
| 9,944,239 | B1 * | 4/2018 | Diep | B60R 16/0222 |
| 2001/0044984 | A1 * | 11/2001 | Ono | B60R 16/0222 16/2.5 |
| 2003/0015338 | A1 * | 1/2003 | Sato | H02G 3/22 174/668 |
| 2003/0015339 | A1 * | 1/2003 | Sato | B60R 16/0222 174/668 |
| 2009/0065235 | A1 * | 3/2009 | Uchibori | B60R 16/0222 174/152 G |
| 2010/0307794 | A1 * | 12/2010 | Baydoun | H02G 3/22 174/152 G |
| 2011/0073350 | A1 | 3/2011 | Okuhara et al. | |
| 2011/0203833 | A1 * | 8/2011 | Miyakoshi | H02G 3/22 174/153 G |
| 2014/0054064 | A1 * | 2/2014 | Gronowicz, Jr | B60R 16/0222 174/152 G |
| 2016/0180988 | A1 * | 6/2016 | Klein | B64C 1/00 174/153 G |
| 2017/0361790 | A1 * | 12/2017 | Kaefer | H01R 9/0524 |
| 2019/0348825 | A1 * | 11/2019 | Ikeda | B60R 16/0238 |
| 2019/0351849 | A1 | 11/2019 | Suenaga et al. | |
| 2020/0079303 | A1 * | 3/2020 | Yoshimura | B60R 16/0222 |
| 2020/0079304 | A1 * | 3/2020 | Yoshimura | B60R 16/0222 |
| 2021/0101543 | A1 * | 4/2021 | Toyoda | B60R 16/0222 |
| 2021/0241944 | A1 * | 8/2021 | Yamaguchi | H01B 17/301 |
| 2021/0257131 | A1 * | 8/2021 | Kiyota | H01B 17/583 |
| 2022/0032864 | A1 * | 2/2022 | Kiyota | B60R 16/0222 |

FOREIGN PATENT DOCUMENTS

| | | | | |
|---|---|---|---|---|
| CN | 106716759 | A * | 5/2017 | B60R 16/02 |
| CN | 108736408 | A * | 11/2018 | B60R 16/0215 |
| CN | 112636283 | A * | 4/2021 | B60R 16/0222 |
| CN | 112918402 | A * | 6/2021 | B60R 16/0215 |
| CN | 113270830 | A * | 8/2021 | H01B 17/583 |
| CN | 113270831 | A * | 8/2021 | F16L 5/00 |
| EP | 1013508 | A2 * | 6/2000 | B60R 16/0222 |
| EP | 3702220 | A1 * | 9/2020 | B60R 16/0215 |
| EP | 3702221 | A1 * | 9/2020 | B60R 16/0215 |
| EP | 3805049 | A1 * | 4/2021 | B60R 16/0222 |
| EP | 3865348 | A1 * | 8/2021 | B60R 16/0222 |
| JP | H02-18217 | U | 2/1990 | |
| JP | 3675116 | B2 * | 7/2005 | F16L 37/0987 |
| JP | 2008310989 | A * | 12/2008 | |
| JP | 2008311033 | A * | 12/2008 | |
| JP | 2008311034 | A * | 12/2008 | B60R 16/0222 |
| JP | 2015-33219 | A | 2/2015 | |
| JP | 2016-10165 | A | 1/2016 | |
| JP | 2017-10638 | A | 1/2017 | |
| JP | 2017-169424 | A | 9/2017 | |
| JP | 2021072693 | A * | 5/2021 | B60R 16/0215 |
| KR | 100944909 | B1 * | 3/2010 | |
| KR | 101498826 | B1 * | 3/2015 | |
| WO | WO-2013186947 | A1 * | 12/2013 | B60R 16/0222 |
| WO | WO-2014024785 | A1 * | 2/2014 | B60R 16/0222 |
| WO | WO-2015145861 | A1 * | 10/2015 | B60R 16/0222 |
| WO | WO-2016043245 | A1 * | 3/2016 | B60R 16/02 |
| WO | WO-2017163801 | A1 * | 9/2017 | B60R 16/02 |
| WO | WO-2019035221 | A * | 2/2019 | F16L 21/08 |

* cited by examiner

WATER-STOP GROMMET AND WIRE HARNESS

CROSS-REFERENCE TO RELATED APPLICATION(S)

The present application claims priority to and incorporates by reference the entire contents of Japanese Patent Application No. 2020-016056 filed in Japan on Feb. 3, 2020.

BACKGROUND OF THE INVENTION

1. Field of the Invention

The present invention relates to a grommet and a wire harness.

2. Description of the Related Art

For example, as a conventional grommet mounted on a vehicle, Japanese Patent Application Laid-open No. 2017-010638 discloses a grommet attached to a through hole formed on a vehicle body panel into which a wire material (wire harness) is inserted. This grommet includes a small diameter cylindrical part, an enlarged diameter cylindrical part, a closing surface part, and an auxiliary cylindrical part. The small diameter cylindrical part forms an insertion hole into which a wire material is inserted. The enlarged diameter cylindrical part is formed such as to expand from the small diameter cylindrical part toward the outside and extend in the axial direction of the small diameter cylindrical part. An annular groove into which a peripheral part of the through hole can be fitted is formed on the outer periphery part of the enlarged diameter cylindrical part. The sealing surface part extends from the inner periphery surface of the enlarged diameter cylindrical part toward the radially inner side, and closes the enlarged diameter cylindrical part. The auxiliary cylindrical part extends from the closing surface part toward one side in the axial direction, and forms an insertion hole into which the wire material is inserted.

The grommet such as disclosed in Japanese Patent Application Laid-open No. 2017-010638 described above stops water by fitting the peripheral part of the through hole into the annular groove. It has been desired that the grommet as described above has a holding force such that the fitting of the peripheral part of the through hole does not come loose from the annular groove, even when the wire material receives a force causing the wire material to tilt in the axial direction.

SUMMARY OF THE INVENTION

The present invention has been made in view of the above circumstances, and an object of the present invention is to provide a grommet and a wire harness that can improve the holding force of a water stop part.

In order to achieve the above mentioned object, a grommet according to one aspect of the present invention a water stop part having an annular shape that stops water by being inserted into a through hole formed on a mounting panel; and a closing part disposed so as to close the annular shape of the water stop part by extending in a radially inner side of the water stop part, wherein the water stop part includes an abutting surface formed in an annular shape capable of coming into contact with one side of a peripheral part of the through hole in an axial direction, and a plurality of claw parts that face the abutting surface in the axial direction, that are capable of coming into contact with another side of the peripheral part of the through hole, and that are intermittently provided in a circumferential direction.

According to another aspect of the present invention, in the grommet, it is possible to configure that the claw parts are disposed along the circumferential direction at equal intervals.

According to still another aspect of the present invention, in the grommet, it is possible to configure that the through hole includes an upright part having a peripheral part that projects toward one side in the axial direction, and the water stop part includes an engagement part that engages a tip end of the upright part to a portion at a radially inner side of the claw parts.

According to still another aspect of the present invention, in the grommet, it is possible to configure that the water stop part includes a concave part having an annular shape into which the peripheral part of the through hole is fitted, and the claw parts are provided in the concave part, and are disposed on a radially inner side of a radial dimension of a portion where the closing part is connected to the water stop part.

In order to achieve the above mentioned object, a wire harness according to still another aspect of the present invention includes a wire material having conductivity; and a grommet provided on the wire material, wherein the grommet includes a water stop part having an annular shape that stops water by being inserted into a through hole formed on a mounting panel, and a closing part disposed so as to close the annular shape of the water stop part by extending in a radially inner side of the water stop part, and the water stop part includes an abutting surface formed in an annular shape capable of coming into contact with one side of a peripheral part of the through hole in an axial direction, and a plurality of claw parts that face the abutting surface in the axial direction, that are capable of coming into contact with another side of the peripheral part of the through hole, and that are intermittently provided in a circumferential direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment according to the present invention will be described in detail with reference to the accompanying drawings. However, the invention is not limited to the embodiment. In addition, components in the following embodiment include those that can be easily replaced by those skilled in the art, or those substantially the same.

Embodiment

Figure 1:
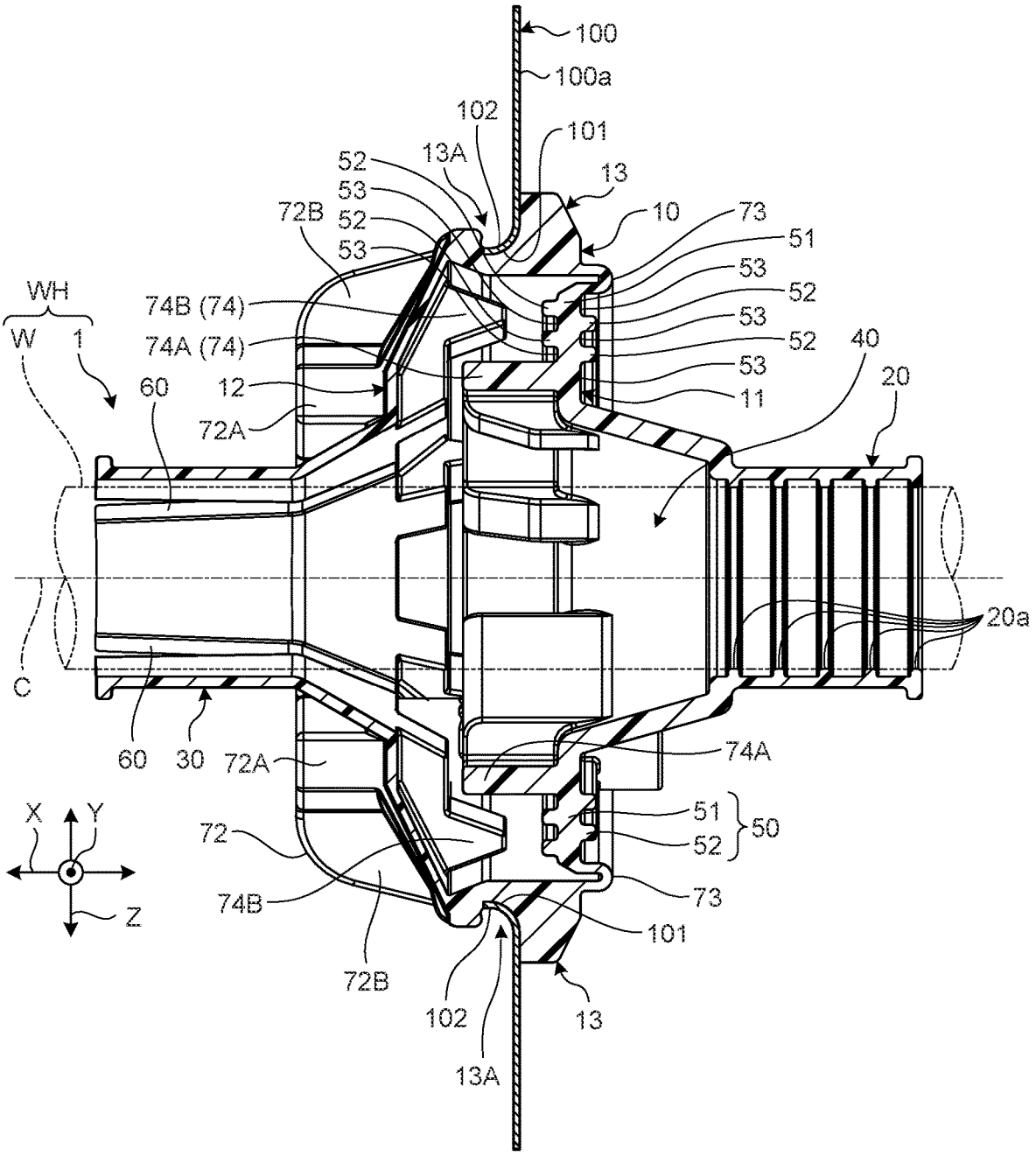
FIG. 1 is a sectional view illustrating a schematic configuration of a wire harness to which a grommet according to an embodiment is applied.
Figure 2:
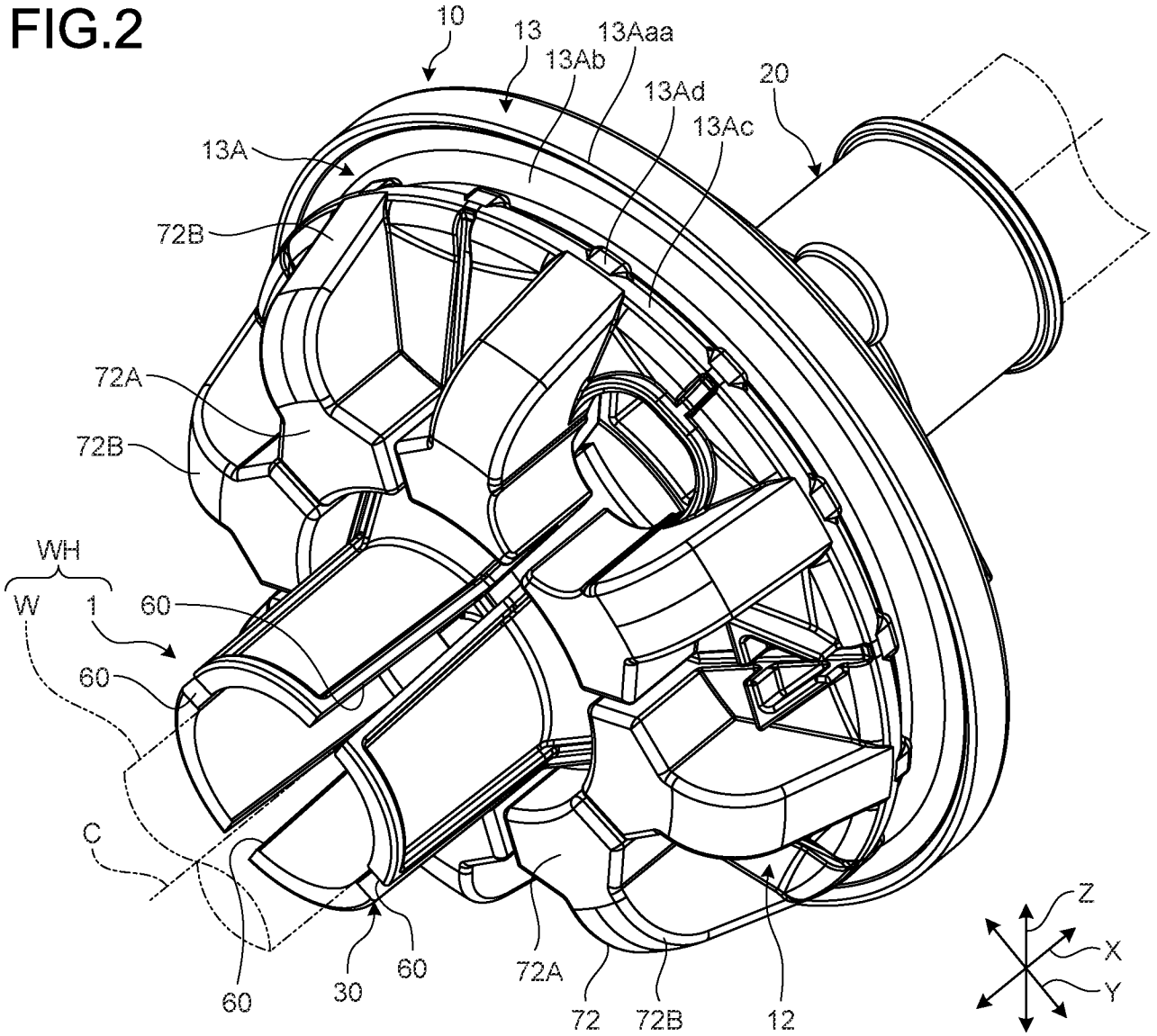
FIG. 2 is a perspective view illustrating a schematic configuration of the wire harness to which the grommet according to the embodiment is applied.
Figure 3:
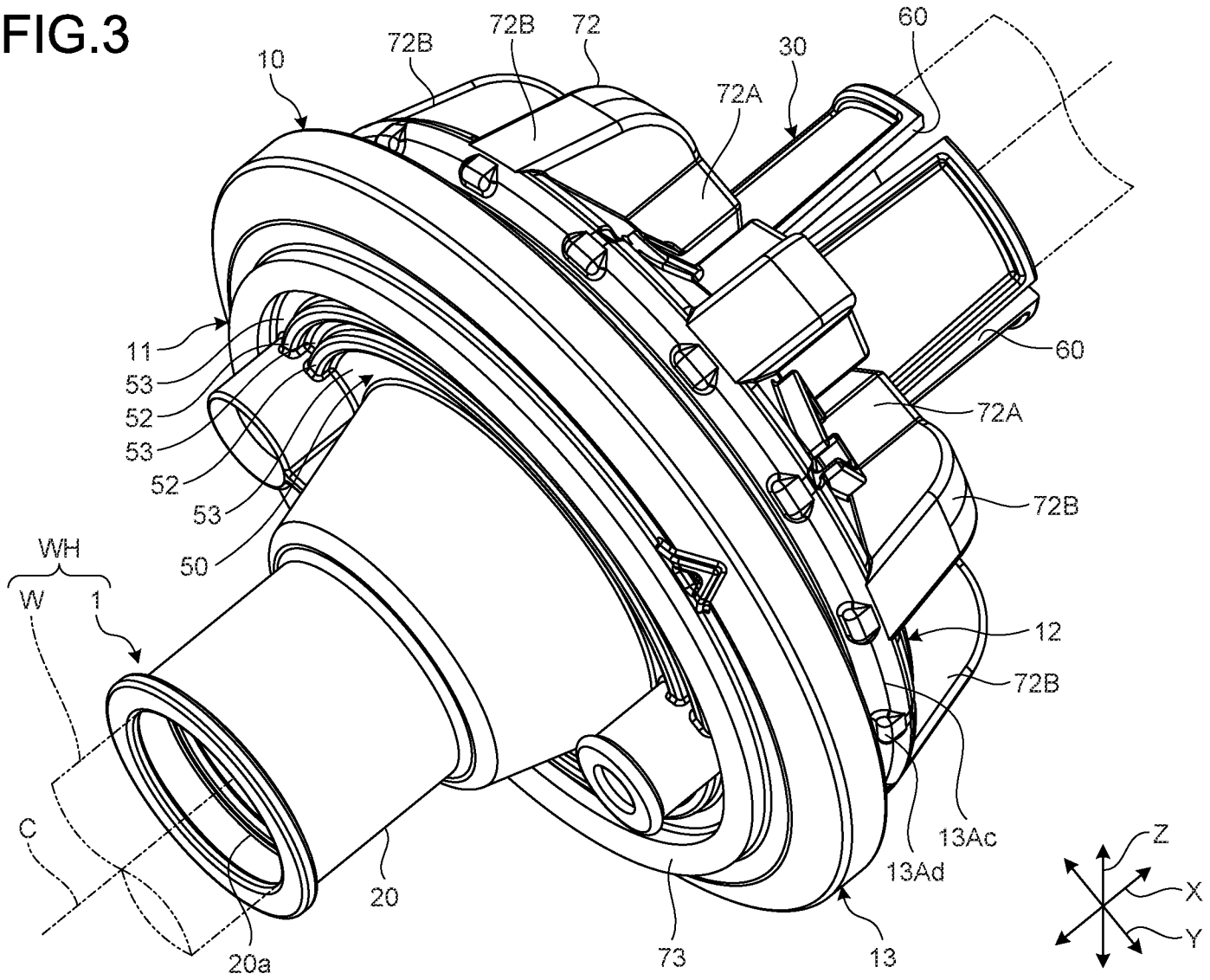
FIG. 3 is a perspective view illustrating a schematic configuration of the wire harness to which the grommet according to the embodiment is applied.

A grommet 1 of the present embodiment illustrated in FIG. 1 to FIG. 3 is incorporated in a wire harness WH routed in a vehicle or the like. In this example, for example, the wire harness WH is a collective component used to connect devices mounted on the vehicle, and is obtained by bundling a plurality of wire materials W used for supplying power or signal communication. The wire materials W are connected to the devices by a connector or the like. The wire harness WH includes the wire materials W having conductivity, and the grommet 1 provided on the wire materials W and into which each of the wire materials W is inserted. The wire harness WH may also include various components such as exterior members including a corrugated tube, a resin tape, and a protector, an electrical junction box, and a fixture. For example, the wire material W is formed of a metal rod, an electric wire, a bundle of electric wires, and the like. The metal rod is formed by covering the outside of a rod-like member having conductivity with a coating part having insulating properties. The electric wire is formed by covering the outside of a conductive part (core wire) made of a plurality of metal strands having conductivity with a coating part having insulating properties. The bundle of electric wires is formed by bundling a plurality of the electric wires. The wire harness WH bundles and aggregates the wire materials W, and various devices are electrically connected via a connector provided on the terminal of the bundled wire materials W or the like.

The grommet 1 is applied to a through hole 101 formed on a mounting panel 100 serving as an object to be mounted, when each of the wire materials W is to be routed across two spaces partitioned by the mounting panel 100 serving as a boundary, through the through hole 101. For example, the mounting panel 100 is a metal plate for forming a body of a vehicle and the like. The through hole 101 penetrates through the mounting panel 100 in a plate thickness direction. Typically, the two spaces partitioned by the mounting panel 100 serving as a boundary are a vehicle interior space (for example, a cabin) and a vehicle exterior space (for example, an engine compartment). When the grommet 1 is assembled to the through hole 101 in a state in which the wire material W of the wire harness WH is inserted therethrough, and is externally disposed around the wire material W, the grommet 1 protects the wire material W that passes through the through hole 101 and stops water from flowing into (waterproofs) the through hole 101. The grommet 1 also has functions such as dustproof and sound insulation in addition to waterproofing the through hole 101. Hereinafter, a configuration of the grommet 1 will be described in detail with reference to the accompanying drawings.

In FIG. 1 to FIG. 3, the mounting panel 100 is omitted in FIG. 2 and FIG. 3. In the following description, of the first direction, the second direction, and the third direction that intersect with each other, the first direction is referred to as an "axial direction X", the second direction is referred to as a "width direction Y", and the third direction is referred to as a "height direction Z". Typically, the axial direction X, the width direction Y, and the height direction Z are orthogonal to each other. In this example, the axial direction X corresponds to the plate thickness direction of the mounting panel 100 described above, and corresponds to the insertion direction of the wire material W and the grommet 1 with respect to the through hole 101. In other words, the axial direction X is the direction along the extending direction of the wire material W inserted into the grommet 1. The width direction Y and the height direction Z correspond to the extending direction of the mounting panel 100. In this example, for easy understanding and convenience, it is assumed that the wire material W is routed in a straight line along the axial direction X. It is not limited thereto, however, and in a state in which the grommet 1 is attached to the mounting panel 100, the axial direction X may also be a bending direction, and a part of the grommet 1 and the wire material W may be bent. Unless otherwise specified, the directions used in the following description are directions in a state in which the grommet 1 is assembled to the mounting panel 100. A center axis line C that passes through the center of the through hole 101 is orthogonal to the plate surface of the mounting panel 100, and extends along the axial direction X. The direction orthogonal to the center axis line C is referred to as a radial direction. The side away from the center axis line C is referred to as a radially outer side, and the side approaching the center axis line C is referred to as a radially inner side. A burring process is performed on the mounting panel 100, and an upright part 102 is formed by projecting the inner edge of the through hole 101 toward one side in the axial direction X. The inside of the upright part 102 is formed as the through hole 101.

More specifically, as illustrated in FIG. 1 to FIG. 3, the grommet 1 of the present embodiment is a sealing member through which the wire material W is inserted in the axial direction X, and that can stop water from flowing into the through hole 101 of the mounting panel 100. The grommet 1 includes a main body part 10, a cylindrical part 20, and a cylindrical part 30, and is formed as an elastic body in which the main body part 10, the cylindrical part 20, and the cylindrical part 30 are integrated. For example, the grommet 1 is formed of an elastic resin material (for example, ethylene-propylene-diene rubber (EPDM) or the like) having a low hardness, high flexibility, and insulating properties such as rubber and thermoplastic elastomer. In the grommet 1, the inner space parts of the main body part 10, the cylindrical part 20, and the cylindrical part 30 function as an insertion space part 40. The insertion space part 40 is a space part through which the wire material W is inserted, and continues across the cylindrical part 20, the main body part 10, and the cylindrical part 30 along the axial direction X. In the grommet 1, the wire material W is inserted along the axial direction X with respect to the insertion space part 40 that is communicably formed across the cylindrical part 20, the main body part 10, and the cylindrical part 30.

The main body part 10 is a part that stops water from flowing into the through hole 101 by fitting into the through hole 101, and through which the wire material W is inserted along the axial direction X. The main body part 10 includes a first partition wall part (closing part) 11, a second partition wall part (closing part) 12, and a water stop part 13.

The first partition wall part 11 and the second partition wall part 12 are spaced apart along the axial direction, face each other at one side and the other side in the axial direction X, and are integrally formed with the water stop part 13. The water stop part 13 is an outer periphery part provided annularly on the end parts of the first partition wall part 11 and the second partition wall part 12 located at the outer side in the radial direction (direction orthogonal to the center axis line C). The first partition wall part 11 and the second partition wall part 12 are disposed on one side and the other side of the water stop part 13 in the axial direction X so as to extend toward the radially inner side of the water stop part 13, and close the annular shape of the water stop part 13. In a state in which the first partition wall part 11 and the second partition wall part 12 are integrally formed with the water stop part 13, the inside as a whole is formed in a hollow dome shape. The cylindrical part 20 is connected to the first partition wall part 11 on a surface opposite to the second partition wall part 12 side in the axial direction X. The cylindrical part 30 is connected to the second partition wall part 12 on a surface opposite to the first partition wall part 11 side in the axial direction X.

As illustrated in FIG. 1 and FIG. 3, the first partition wall part 11 forms a sound insulation wall part 50. The sound insulation wall part 50 is formed in an annular plate shape around and along the center axis line C. The sound insulation wall part 50 includes a plate-like part 51 formed in an annular plate shape. The sound insulation wall part 50 also includes a plurality of sound insulation convex parts 52 that project from both surfaces of the plate-like part 51 in the axial direction X, that are formed in an annular shape or a arc shape around the center axis line C, and that are provided in the radial direction at intervals. A gap part 53 is interposed between the sound insulation convex parts 52, and is also provided at the radially outer side and the radially inner side of the sound insulation convex parts 52. The grommet 1 of the present embodiment ensures sound insulation by partially increasing the thickness of the sound insulation wall part 50 in the axial direction X by the sound insulation convex parts 52. Moreover, the grommet 1 of the present embodiment ensures excellent workability when the main body part 10 is to be expanded and deformed by the gap part 53 arranged between the sound insulation convex parts 52 and at the radially both sides. As a result, the grommet 1 can ensure sound insulation as well as excellent workability when the main body part 10 is expanded and deformed.

As illustrated in FIG. 1 and FIG. 3, the first partition wall part 11 forms a folded part 73. The folded part 73 extends in the axial direction X, folded back in the radial direction, and extends again in the axial direction X. An end part of the folded part 73 before extending in the axial direction X is integrally connected to the outer end part at the radially outer side of the plate-like part 51 in the sound insulation wall part 50. The radially outer end of the folded part 73 after folded back in the radial direction and extended in the axial direction X is also integrally connected to the water stop part 13. In the grommet 1 of the present embodiment, the folded part 73 is elastically deformed between the sound insulation wall part 50 and the water stop part 13, and the deformation of the main body part 10 at the sound insulation wall part 50 side is prevented from being transmitted to the water stop part 13. Consequently, it is possible to maintain the water stopping performance of the water stop part 13.

As illustrated in FIG. 1 to FIG. 3, the second partition wall part 12 forms a projecting part 72. In the second partition wall part 12, the projecting part 72 projects toward the outside (side opposite to the first partition wall part 11 in the axial direction X). The projecting part 72 includes an annular-shaped projecting part 72A formed in an annular shape around the center axis line C so as to surround the base end part of the cylindrical part 30. The projecting part 72 also includes a plurality of radially projecting parts 72B that extend from the annular-shaped projecting part 72A toward the radially outer side, and that are radially placed around the center axis line C. In the present embodiment, the radially projecting parts 72B are placed at eight locations in the circumferential direction at equal intervals. The grommet 1 of the present embodiment improves the strength of the second partition wall part 12 by the projecting part 72, and suppresses deformation.

As illustrated in FIG. 1, the first partition wall part 11 and the second partition wall part 12 form an interference part 74. The interference part 74 includes a first interference convex part 74A that projects from the inner surface of the insertion space part 40 in the first partition wall part 11 toward the inside of the insertion space part 40. The interference part 74 also includes a second interference convex part 74B that projects from the inner surface of the insertion space part 40 of the second partition wall part 12 toward the inside of the insertion space part 40. In the first partition wall part 11, the first interference convex part 74A is formed in an annular shape around the center axis line C. In the second partition wall part 12, a plurality of the second interference convex parts 74B are formed along the circumferential direction around the center axis line C at intervals, so as to surround the radially outer side of the first interference convex part 74A. When the wire material W is inclined in a direction intersecting with respect to the axial direction X, the grommet 1 of the present embodiment suppresses the deformation of the main body part 10 using the interference part 74, by bringing the first interference convex part 74A formed on the first partition wall part 11 and the second interference convex part 74B formed on the second partition wall part 12 into contact with each other. In the grommet 1 of the present embodiment, the deformation of the first partition wall part 11 and the second partition wall part 12 in the radial direction is prevented by the interference part 74, and the deformation is suppressed from being transmitted to the water stop part 13. Consequently, it is possible to maintain the water stopping performance of the water stop part 13.

The water stop part 13 is integrally formed between the first partition wall part 11 and the second partition wall part 12. The water stop part 13 is located at the radially outer side from where the thickness is changed with respect to the first partition wall part 11, and in the present embodiment, the water stop part 13 is located at the radially outer side of the folded part 73. The water stop part 13 is also located at the radially outer side from where the thickness is changed with respect to the second partition wall part 12, and in the present embodiment, the water stop part 13 is located at the radially outer side of the radially outer end of the radially projecting parts 72B in the projecting part 72. The water stop part 13 is a sealing member inserted into the through hole 101 of the mounting panel 100 and that stops water from flowing into the through hole 101. The water stop part 13 is formed in an annular shape around the center axis line C corresponding to the annular shape of the through hole 101. In the present embodiment, the through hole 101 is formed in a circular shape, and the water stop part 13 is correspondingly formed in a circular shape.

Figure 4:
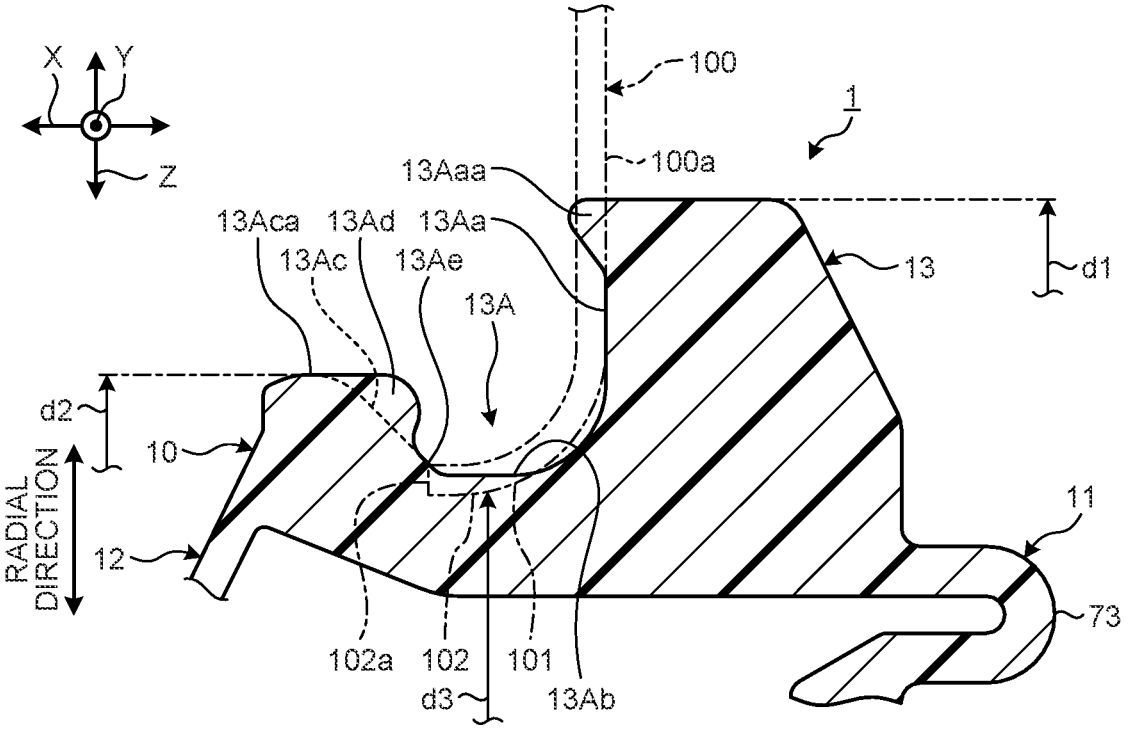
FIG. 4 is a partially enlarged sectional view of the grommet according to the embodiment.
Figure 5:
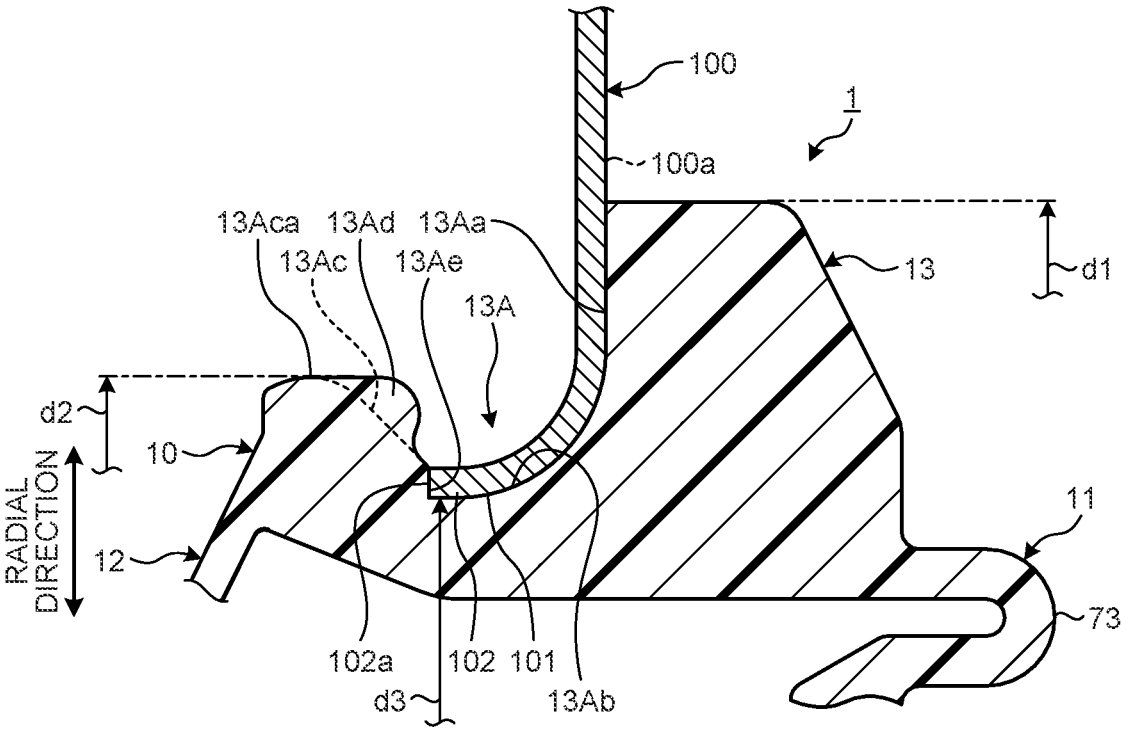
FIG. 5 is a partially enlarged sectional view of the grommet according to the embodiment.

As illustrated in FIG. 1 to FIG. 5, a groove-shaped concave part 13A is formed on the water stop part 13 such that the concave part 13A continues annularly around the outer periphery surface of the water stop part 13. The concave part 13A is a part into which the peripheral part of the through hole 101 is fitted, and is opened toward the radially outer side. As illustrated in FIG. 1 and FIG. 5, in a state of being attached to the mounting panel 100, the concave part 13A includes an abutting surface 13Aa that comes into contact with a plate surface 100*a* that faces opposite in the axial direction X from the direction toward which the upright part 102 stands upright in the through hole 101. As illustrated in FIG. 4, in the concave part 13A, a projection 13Aaa is formed on the radially outer edge of the abutting surface 13Aa. The projection 13Aaa is formed in an annular shape continuously around the center axis line C. As illustrated in FIG. 5, the projection 13Aaa functions as what is called a water stop lip part that comes into close contact with the plate surface 100*a* of the peripheral part, which comes into contact with the plate surface 100*a* of the mounting panel 100 and forms the through hole 101 by being elastically deformed, and that seals the entire periphery of the through hole 101. The radially outer edge of the abutting surface 13Aa having the projection 13Aaa is a portion located at the most radially outer side of the water stop part 13 as well as a portion located at the most radially outer side of the grommet 1, and forms the maximum radial dimension d1 illustrated in FIG. 4 and FIG. 5. Moreover, as illustrated in FIG. 1 and FIG. 5, in the concave part 13A, in a state of being attached to the mounting panel 100, a groove bottom 13Ab comes into contact with the inside of the upright part 102 forming the opening edge of the through hole 101.

As illustrated in FIG. 4 and FIG. 5, the concave part 13A includes an inclination surface 13Ac, which is extending in an oblique manner from the groove bottom 13Ab toward one side in the axial direction X (direction away from the abutting surface 13Aa) and toward the radially outer side, at the side that faces the abutting surface 13Aa in the axial direction X with the groove bottom 13Ab interposed therebetween. A top part 13Aca extending to the most radially outer side of the inclination surface 13Ac is a part where the second partition wall part 12 is connected, located at the most radially outer side, and forms a radial dimension d2. The radial dimension d2 of the top part 13Aca is larger than an inner diameter d3 of the through hole 101, but is smaller than the maximum radial dimension d1 of the grommet 1 and the water stop part 13 described above. A portion from the groove bottom 13Ab to the top part 13Aca via the inclination surface 13Ac is temporarily deformed corresponding to the inner diameter d3 of the through hole 101, while the water stop part 13 is inserted into the through hole 101. When the water stop part 13 is further inserted into the through hole 101, the portion from the groove bottom 13Ab to the top part 13Aca returns to the radial dimension d2 of the top part 13Aca due to the elastic force, and the groove bottom 13Ab comes into contact with the inside of the upright part 102.

As illustrated in FIG. 4 and FIG. 5, in the concave part 13A, the inclination surface 13Ac includes a claw part 13Ad. The claw part 13Ad projects from the inclination surface 13Ac toward the abutting surface 13Aa. As illustrated in FIG. 2 and FIG. 3, a plurality of the claw parts 13Ad are intermittently provided in the circumferential direction. The claw parts 13Ad are disposed along the circumferential direction at equal intervals. The claw parts 13Ad are disposed on the radially inner side of the radial dimension d2 of the portion where the second partition wall part 12 is connected to the water stop part 13, formed by the top part 13Aca of the inclination surface 13Ac, and are provided inside of the concave part 13A.

As illustrated in FIG. 4 and FIG. 5, the concave part 13A includes an engagement part 13Ae on a portion in the midway from the inclination surface 13Ac to the groove bottom 13Ab, the portion being at the radially inner side of the claw parts 13Ad. In a state in which the water stop part 13 is inserted into the through hole 101 and is attached to the mounting panel 100, the engagement part 13Ae is a part that is elastically deformed by the upright part 102 with the groove bottom 13Ab, whereby a tip end 102*a* of the upright part 102 bites in the engagement part 13Ae. Consequently, the engagement part 13Ae engages the tip end 102*a* of the upright part 102.

The cylindrical parts 20 and 30 are integrally formed into a cylindrical shape with the main body part 10, and has the wire material W being inserted therethrough along the axial direction X.

The cylindrical part 20 is formed so as to project from the first partition wall part 11 toward the second side (side opposite to the second partition wall part 12) along the axial direction X. The cylindrical part 20 is formed in a cylindrical shape around the center axis line C, and extends along the axial direction X. The cylindrical part 20 is formed in a cylindrical shape having a diameter that is smaller than that of the first partition wall part 11. In the cylindrical part 20, the tip end part of the second side in the axial direction X is opened, and the base end part of the first side is connected to the first partition wall part 11. A lip part 20*a* is formed on the inner periphery surface of the cylindrical part 20. The lip part 20*a* is a pleated-like water stop portion formed in an annular shape along the circumferential direction, and a plurality of the lip parts 20*a* are provided along the axial direction X at intervals. In a state in which the wire material W is inserted into the cylindrical part 20, each of the lip parts 20*a* is brought into contact with the outer surface of the wire material W, and stops water from flowing to the outer surface.

The cylindrical part 30 is formed so as to project from the second partition wall part 12 toward the first side (side opposite to the first partition wall part 11) along the axial direction X. The cylindrical part 30 is formed in a cylindrical shape around the center axis line C, and extends along the axial direction X. The cylindrical part 30 is formed in a cylindrical shape having a diameter that is smaller than that of the second partition wall part 12. In the cylindrical part 30, the tip end part of the first side in the axial direction X is opened, and the base end part of the second side is connected to the second partition wall part 12.

In the grommet 1 of the present embodiment, a cut-out part 60 is formed on the second partition wall part 12 and the cylindrical part 30 provided on the second partition wall part 12. The cut-out part 60 separates the cylindrical part 30 and the second partition wall part 12. The cut-out part 60 is formed along the axial direction X, and a plurality of the cut-out parts 60 are formed along the circumferential direction around the center axis line C at equal intervals.

After the grommet 1 configured as described above is fitted to the wire material W such that the wire material W is inserted into the insertion space part 40 that is the inner space parts of the main body part 10, the cylindrical part 20, and the cylindrical part 30, the grommet 1 is inserted into the through hole 101 from the cylindrical part 30 side with the tip end of the wire material W. The grommet 1 is assembled to the mounting panel 100, by fitting the main body part 10 into the through hole 101 such that the peripheral part of the through hole 101 is fitted to the water stop part 13 of the main body part 10. In the grommet 1, the concave part 13A is fitted into the through hole 101, by inserting the top part 13Aca of the inclination surface 13Ac of the water stop part 13 from the opposite side in the axial direction X from the tip end 102*a* of the upright part 102 of the through hole 101, and when the inclination surface 13Ac and the claw parts 13Ad pass through the upright part 102 while elastically deforming along the upright part 102. In the fitting state, the grommet 1 seals the entire peripheral part of the through hole 101, when the projection 13Aaa of the concave part 13A in the water stop part 13 is elastically deformed, the abutting surface 13Aa comes into close contact with the plate surface 100*a* of the mounting panel 100 at the peripheral part of the through hole 101, and when the groove bottom 13Ab comes into close contact with the inside of the upright part 102 that forms the peripheral part of the through hole 101. The grommet 1 may also stop water from flowing into the openings of the cylindrical parts 20 and 30, by winding a winding tape around the wire material W inserted into the insertion space part 40, and over the cylindrical parts 20 and 30 and the wire material W. In this manner, the grommet 1 and the wire harness WH stop water from flowing into the through hole 101 and have the wire material W inserted therethrough, by fitting the main body part 10 into the through hole 101 formed on the mounting panel 100.

The grommet 1 and the wire harness WH of the present embodiment include the water stop part 13 having an annular shape that stops water by being inserted into the through hole 101 formed on the mounting panel 100, and the closing part serving as the first partition wall part 11 or the second partition wall part 12 disposed so as to close the annular shape of the water stop part 13 by extending in the radially inner side of the water stop part 13. The water stop part 13 of the grommet 1 and the wire harness WH of the present embodiment includes the abutting surface 13Aa formed in an annular shape capable of coming into contact with one side of the peripheral part of the through hole 101 in the axial direction X, and the claw parts 13Ad that face the abutting surface 13Aa in the axial direction X, that are capable of coming into contact with the other side of the peripheral part of the through hole 101, and that are intermittently provided in the circumferential direction.

Consequently, the grommet 1 and the wire harness WH can ensure the water stopping performance of the entire peripheral part of the through hole 101, by bringing the abutting surface 13Aa having an annular shape of the water stop part 13 into contact with one side of the peripheral part of the through hole 101. When an external force is generated in the direction in which the abutting surface 13Aa is separated from the peripheral part of the through hole 101, the grommet 1 and the wire harness WH can also prevent a situation in which the abutting surface 13Aa is separated from the peripheral part of the through hole 101, by bringing the claw parts 13Ad that face the abutting surface 13Aa in the axial direction X into contact with the other side of the peripheral part of the through hole 101. As a result, the grommet 1 and the wire harness WH can improve the holding force of the water stop part 13, and maintain the water stopping performance.

Even if the claw parts 13Ad are continuously disposed over the entire circumference in the circumferential direction, it is possible to improve the holding force of the water stop part 13 and maintain the water stopping performance. However, when the claw parts 13Ad are continuously disposed over the entire circumference in the circumferential direction, the rigidity of the water stop part 13 increases, and it may become difficult to insert the water stop part 13 into the through hole 101. Thus, by intermittently providing the claw parts 13Ad in the circumferential direction, the grommet 1 and the wire harness WH can prevent a situation in which the water stop part 13 is inhibited from being inserted into the through hole 101.

More specifically, the grommet 1 and the wire harness WH of the present embodiment can ensure the water stopping performance of the entire peripheral part of the through hole 101, by bringing the abutting surface 13Aa having an annular shape of the water stop part 13 into contact with the plate surface 100*a* of the peripheral part forming the through hole 101. In addition, the grommet 1 and the wire harness WH of the present embodiment include the claw parts 13Ad that face the abutting surface 13Aa in the axial direction X. Thus, for example, when the wire material W is inclined with respect to the center axis line C, and an external force is generated in the direction in which a part of the abutting surface 13Aa is separated from the peripheral part of the through hole 101, the grommet 1 and the wire harness WH prevent a situation in which the abutting surface 13Aa is separated from the peripheral part of the through hole 101, by bringing the claw parts 13Ad into contact with the upright part 102 of the peripheral part forming the through hole 101. As a result, the grommet 1 and the wire harness WH of the present embodiment can improve the holding force of the water stop part 13, and maintain the water stopping performance.

In this example, the grommet 1 and the wire harness WH of the present embodiment maintain the water stopping performance of the water stop part 13, by suppressing the deformation from being transmitted to the water stop part 13 by the folded part 73 of the first partition wall part 11. The grommet 1 and the wire harness WH also maintain the water stopping performance of the water stop part 13, by preventing the deformation of the first partition wall part 11 and the second partition wall part 12 in the radial direction by the interference part 74 of the first partition wall part 11 and the second partition wall part 12, and by suppressing the deformation from being transmitted to the water stop part 13. Consequently, for example, the grommet 1 and the wire harness WH of the present embodiment are configured such that even if an external force causing the wire material W to incline with respect to the center axis line C is generated, the external force is not transmitted to the water stop part 13. Thus, it is possible to ensure the water stopping performance. In the grommet 1 and the wire harness WH of the present embodiment, the claw parts 13Ad can further ensure the water stopping performance in addition to the functions of the folded part 73 and the interference part 74 described above.

Moreover, in the grommet 1 and the wire harness WH of the present embodiment, the claw parts 13Ad are disposed along the circumferential direction at equal intervals.

Consequently, because the claw parts 13Ad are disposed along the circumferential direction at equal intervals, the grommet 1 and the wire harness WH can uniformly prevent a situation in which the abutting surface 13Aa is separated from the peripheral part of the through hole 101, in the circumferential direction of the water stop part 13. Moreover, because the claw parts 13Ad are disposed along the circumferential direction at equal intervals, the grommet 1 and the wire harness WH can uniformly apply an insertion force, which is generated when the water stop part 13 is inserted into the through hole 101, in the circumferential direction of the water stop part 13.

Furthermore, in the grommet 1 and the wire harness WH of the present embodiment, the through hole 101 includes the upright part 102 having a peripheral part that projects toward one side in the axial direction X, and the engagement part 13Ae that engages the tip end 102*a* of the upright part 102 to the portion at the radially inner side of the claw parts 13Ad.

The engagement part 13Ae engages the tip end 102*a* of the upright part 102 in the radially inner side of the claw parts 13Ad. Consequently, the grommet 1 and the wire harness WH prevent a situation in which the abutting surface 13Aa is separated from the peripheral part of the through hole 101, because the engagement part 13Ae receives the tip end 102*a* of the upright part 102, when an external force is generated in the direction in which a part of the abutting surface 13Aa is separated from the peripheral part of the through hole 101. As a result, the grommet 1 and the wire harness WH can further improve the holding force of the water stop part 13, and maintain the water stopping performance with more certainty.

Still furthermore, in the grommet 1 and the wire harness WH of the present embodiment, the water stop part 13 includes the concave parts 13A having an annular shape into which the peripheral part of the through hole 101 is fitted, and the claw parts 13Ad are provided in the concave part 13A and are disposed on the radially inner side of the radial dimension d2 of the portion where the closing part (second partition wall part 12 in the present embodiment) is connected to the water stop part 13. In other words, in the grommet 1 and the wire harness WH of the present embodiment, the claw parts 13Ad projects to the radially outer side less outside than the portion where the second partition wall part 12 is connected to the water stop part 13 does.

Consequently, because the claw parts 13Ad are disposed on the radially inner side of the radial dimension d2 of the portion, the grommet 1 and the wire harness WH prevent a situation in which the claw parts 13Ad are caught to the peripheral part of the through hole 101, when the portion where the second partition wall part 12 is connected to the water stop part 13 is to be inserted into the through hole 101. As a result, the grommet 1 and the wire harness WH can prevent a situation in which the water stop part 13 is inhibited from being inserted into the through hole 101.

The grommet 1 and the wire harness WH according to the embodiment of the present invention described above are not limited to the embodiment described above, and various modifications may be made within the scope and spirit of the appended claims. Moreover, the grommet 1 and the wire harness WH according to the present embodiment may be configured by appropriately combining the components of the embodiment and modification described above.

The grommet and the wire harness according to the present embodiment can ensure the water stopping performance of the entire peripheral part of the through hole, by bringing the abutting surface having an annular shape of the water stop part into contact with one side of the peripheral part of the through hole. When an external force is generated on the water stop part in the direction in which the abutting surface is separated from the peripheral part of the through hole, the grommet and the wire harness prevent a situation in which the abutting surface is separated from the peripheral part of the through hole, by bringing the claw parts that face the abutting surface in the axial direction into contact with the other side of the peripheral part of the through hole. As a result, the grommet and the wire harness can improve the holding force of the water stop part, and maintain the water stopping performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A grommet, comprising:

a water stop part having an annular shape that stops water by being inserted into a through hole formed on a mounting panel; and a closing part disposed so as to close the annular shape of the water stop part by extending in a radially inner side of the water stop part, wherein the water stop part includes an abutting surface formed in an annular shape capable of coming into contact with one side of a peripheral part of the through hole in an axial direction, and a plurality of claw parts that face the abutting surface in the axial direction, that are capable of coming into contact with another side of the peripheral part of the through hole, and that are intermittently provided in a circumferential direction.

2. The grommet according to claim 1, wherein the plurality of claw parts are disposed along the circumferential direction at equal intervals.

3. The grommet according to claim 1, wherein the through hole includes an upright part having the peripheral part that projects toward one side in the axial direction, and the water stop part includes an engagement part that engages a tip end of the upright part to a portion at a radially inner side of the claw parts.

4. The grommet according to claim 2, wherein the through hole includes an upright part having the peripheral part that projects toward one side in the axial direction, and the water stop part includes an engagement part that engages a tip end of the upright part to a portion at a radially inner side of the claw parts.

5. The grommet according to claim 1, wherein the water stop part includes a concave part having an annular shape into which the peripheral part of the through hole is fitted, and the claw parts are provided in the concave part, and are disposed on a radially inner side of a radial dimension of a portion where the closing part is connected to the water stop part.

6. The grommet according to claim 2, wherein the water stop part includes a concave part having an annular shape into which the peripheral part of the through hole is fitted, and the claw parts are provided in the concave part, and are disposed on a radially inner side of a radial dimension of a portion where the closing part is connected to the water stop part.

7. The grommet according to claim 3, wherein the water stop part includes a concave part having an annular shape into which the peripheral part of the through hole is fitted, and the claw parts are provided in the concave part, and are disposed on a radially inner side of a radial dimension of a portion where the closing part is connected to the water stop part.

8. The grommet according to claim 4, wherein the water stop part includes a concave part having an annular shape into which the peripheral part of the through hole is fitted, and the claw parts are provided in the concave part, and are disposed on a radially inner side of a radial dimension of a portion where the closing part is connected to the water stop part.

9. A wire harness, comprising:

a wire material having conductivity; and a grommet provided on the wire material, wherein the grommet includes a water stop part having an annular shape that stops water by being inserted into a through hole formed on a mounting panel, and a closing part disposed so as to close the annular shape of the water stop part by extending in a radially inner side of the water stop part, and the water stop part includes an abutting surface formed in an annular shape capable of coming into contact with one side of a peripheral part of the through hole in an axial direction, and a plurality of claw parts that face the abutting surface in the axial direction, that are capable of coming into contact with another side of the peripheral part of the through hole, and that are intermittently provided in a circumferential direction.

* * * * *